US007199774B2

(12) United States Patent
Huang

(10) Patent No.: US 7,199,774 B2
(45) Date of Patent: Apr. 3, 2007

(54) LIQUID CRYSTAL DISPLAY

(75) Inventor: Shih-Hsiung Huang, Pingjhen (TW)

(73) Assignee: AU Optronics Corp., Hsinchu (TW)

( * ) Notice: Subject to any disclaimer, the term of this patent is extended or adjusted under 35 U.S.C. 154(b) by 380 days.

(21) Appl. No.: 10/781,518

(22) Filed: Feb. 17, 2004

(65) Prior Publication Data

US 2005/0179630 A1 Aug. 18, 2005

(51) Int. Cl.
*G09G 3/36* (2006.01)

(52) U.S. Cl. ..... 345/87; 345/90; 345/98

(58) Field of Classification Search ..... 345/87–100, 345/204–212, 690
See application file for complete search history.

(56) References Cited

U.S. PATENT DOCUMENTS 6,999,058 B1 * 2/2006 Yano et al. ..... 345/101

2004/0169618 A1 * 9/2004 Nakai et al. ..... 345/1.1

* cited by examiner

*Primary Examiner*—Vijay Shankar
(74) *Attorney, Agent, or Firm*—Thomas, Kayden, Horstemeyer & Risley

(57) ABSTRACT

A liquid crystal display. The liquid crystal display having a power device, a display unit array, a scan driver, a selection device, and a current limiting device. In normal operation of the liquid crystal display, according to the operation of the selection device, a voltage signal applied from the power device is directly applied to the scan driver according to the selection device, and the scan driver sequentially outputs scan signals to scan electrodes. During shutdown and power on processes of the liquid crystal display, according to the operation of the selection device, the voltage signal applied from the power device is applied to the scan driver through the current limiting device, limiting the instantaneous current from the power device. Moreover, the scan driver simultaneously outputs all the scan signals to erase charges within all the display units.

8 Claims, 3 Drawing Sheets

LIQUID CRYSTAL DISPLAY

BACKGROUND OF THE INVENTION

1. Field of the Invention

The present invention relates to a flat liquid crystal display and in particular to a liquid crystal display reducing instantaneous current loaded by a scan driver during shutdown and power on processes of the liquid crystal display.

2. Description of the Related Art

FIG. 1 shows a schematic diagram of a conventional liquid crystal display. The liquid crystal display comprises a display array 10, a scan driver 11, a data driver 12, and a power device 13. The display array 10 is formed by interlacing data electrodes $D1_1$ to $D1_n$ and scan electrodes $G1_1$ to $G1_m$. Each set of the interlacing data electrode and scan electrode corresponds to one display unit. The power device 13 applies a voltage signal V13 to the scan driver 11. In normal operation of the liquid crystal display, the scan driver 11 sequentially outputs the received voltage signal V13 to scan electrodes $G1_1$ to $G1_m$ according to a gate control signal. When receiving the scan signal, the scan electrode corresponding to a row turns on thin film transistors (hereinafter referred to as "TFT") within all display units corresponding to the row. It is noted that signals carried on the scan electrodes $G1_1$ to $G1_m$ are generally called scan signals. Thus, in the following description of the related art, each signal output from the scan driver 11 to the scan electrodes $G1_1$ to $G1_m$ is referred to as a "scan signal" and a voltage level of each scan signal is at that of voltage signal V13.

When the TFTs within all display units corresponding to a row are all turned on, the data driver 12 outputs corresponding video signals with grayscale values to the n display units corresponding to the row through the data electrodes $D1_1$ to $D1_n$ according to image data prepared but not yet displayed. Each time the scan driver 11 finishes scanning all m rows, the operation to display a single frame is completed. Therefore, display images is achieved by repeatedly scanning the scan electrodes and outputting the video signals.

During shutdown and power on processes, an Xon function of the LCD detects large current and then generates an Xon signal. When detecting the signal Xon, the scan driver 11 outputs simultaneous scan signals to all the scan electrodes $G1_1$ to $G1_m$ to immediately turn on the TFTs within all the display units. As a result, discharge of each display unit is completed immediately, eliminating residual images and charges in the display units.

In normal operation, because the scan driver 11 sequentially outputs the scan signal to the scan electrodes $G1_1$ to $G1_m$, output power of the power device 13 is dispersed. However, during shutdown and power on processes, the scan driver 11 detects the Xon signal and then simultaneously outputs the scan signals to all the scan electrodes $G1_1$ to $G1_m$. The output power of the power device 13 is centralized. Thus, when the scan driver 11 simultaneously outputs the scan signals to all the scan electrodes $G1_1$ to $G1_m$, a Vgh bonding area for transmitting the scan signals cannot load high power from the power device 13. After the liquid crystal display power on and off many times, holes occue in the Vgh bonding area, that is, high impedance occurs in the trace of the Vgh bonding area and impact the normal operation of the scan driver 11.

SUMMARY OF THE INVENTION

Accordingly, an object of the present invention is to provide a liquid crystal display. During shutdown and power on processes of the liquid crystal display, instantaneous current, loaded by the scan driver and generated from the voltage applied by the power device, is reduced, utilizing the selection device and the current limiting device.

According to the object described above, the present invention provides a liquid crystal display. The liquid crystal display comprises a power device, a display unit array, a scan driver, a selection device, and a current limiting device. The scan driver is coupled to the power device and outputs scan signals to the display unit array. In normal operation of the liquid crystal display, the scan driver sequentially outputs the scan signals to the display unit array. During shutdown and power on processes of the liquid crystal display the scan driver outputs an erase signal and all the scan signals.

The selection device has a first input terminal coupled to the power device, a first output terminal coupled to the scan driver, a second output terminal, and a first control terminal. When the first control terminal receives the erase signal, the selection device couples the first input terminal to the second output terminal. The current limiting device is coupled between the second output terminal and the scan driver. When the scan driver simultaneously outputs all the scan signals, the current limiting device limits instantaneous current from the power device.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
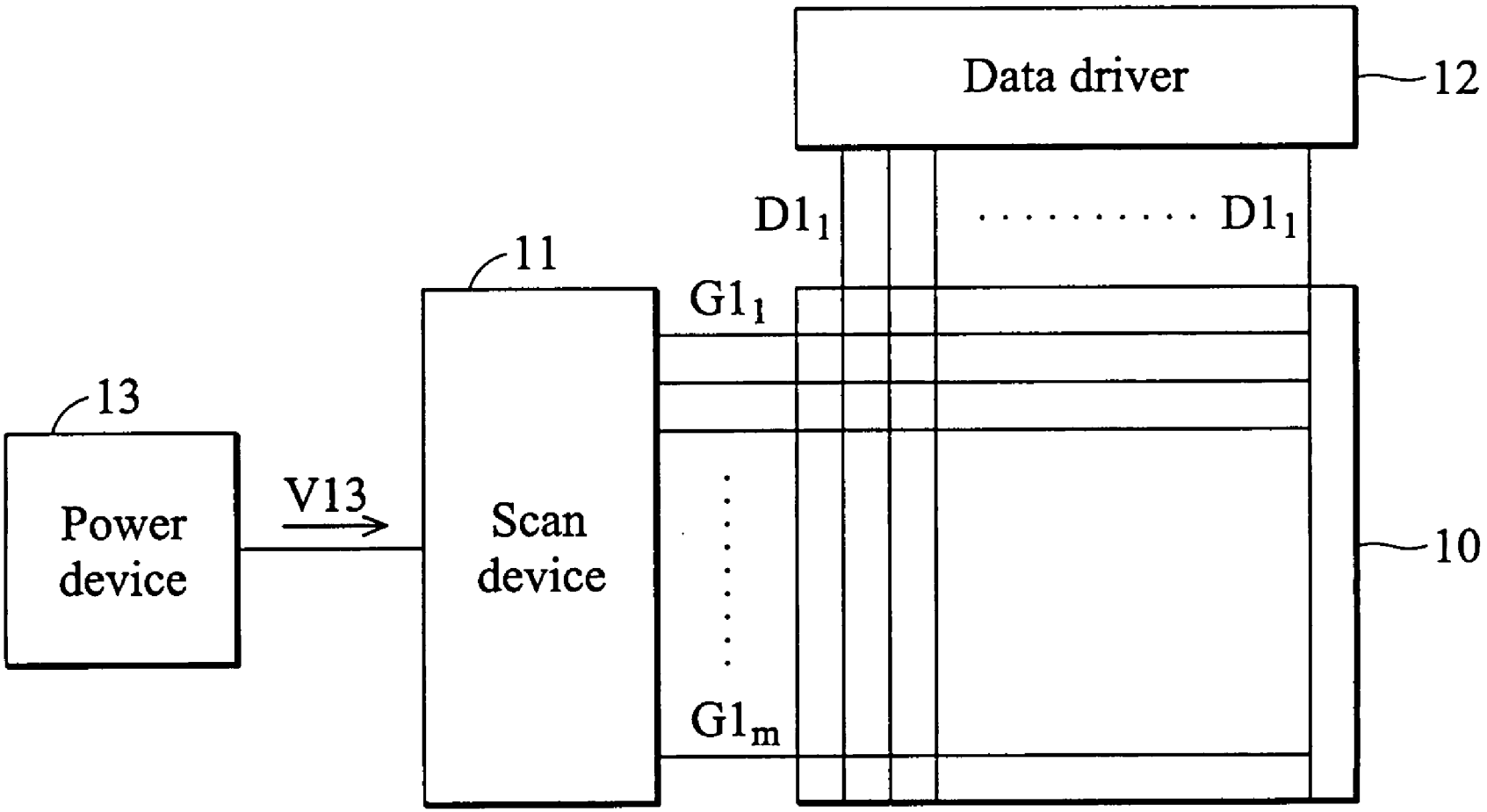
FIG. 1 (RELATED ART)
FIG. 1 shows a schematic diagram of a conventional liquid crystal display.
Figure 2:
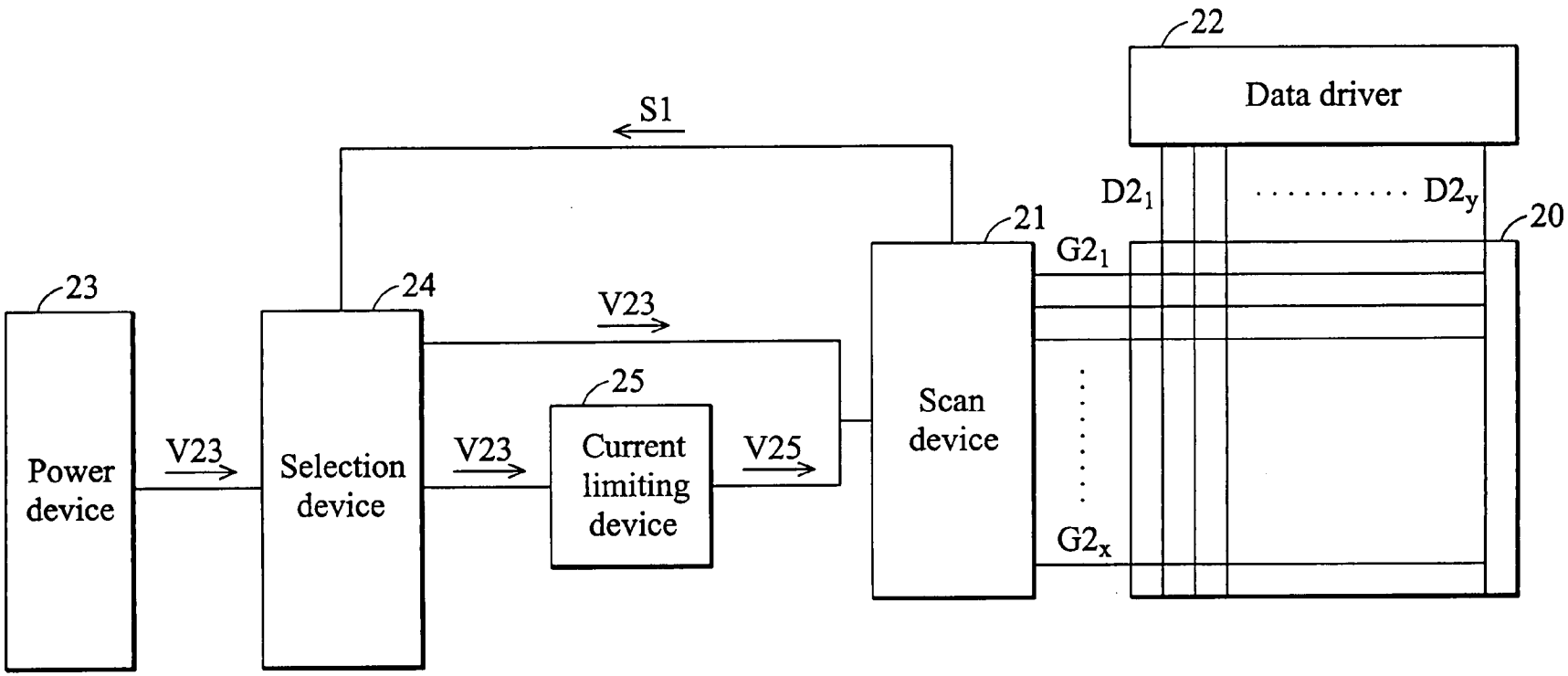
FIG. 2 is a block diagram of a liquid crystal display of the present invention.

FIG. 2 is a block diagram of a liquid crystal display of the present invention. The liquid crystal display comprises a display unit array 20, a scan driver 21, and a data driver 22, a power device 23, a selection device 24 and a current limiting device 25. The display area 20 is formed by interlacing data electrodes $D2_1$ to $D2_n$ and scan electrodes $G2_1$ to $G2_x$. Each set of interlacing data and scan electrodes corresponds to one display unit. The power device 23 applies a voltage signal V23 to the selection device 24. In normal operation of the liquid crystal display, the selection device 24 couples its own input terminal in24 to output terminal out41, and the power device 23 directly applies the voltage signal V23 thereto. Then, the scan driver 21 sequentially outputs the voltage signal V23 to the scan electrodes $G2_1$ to $G2_x$ to turn on TFTs within all display units in a row. In the following detailed description of the invention, each signal output from the scan driver 21 to the scan electrodes $G2_1$ to $G1_x$ is referred to as "scan signal".

During shutdown process of the liquid crystal display, the scan driver 21 detects an Xon signal according to its own Xon function and then outputs an erase signal S1 to the selection device 24, for driving the selection device 24 to couple its own input terminal in24 to output terminal out42. The voltage signal V23 applied from the power device 23 is output to the current limiting device 25 through the selection device 24. The current limiting device 25 outputs a voltage signal V25 to the scan driver 21. Then, the scan driver 21 simultaneously outputs scan signals, all at a voltage level of the voltage signal V25, to all the scan electrodes $G2_1$ to $G2_x$ to immediately turn on the TFTs within all the display units, so that discharge of each display unit is completed immediately, eliminating residual images. In this situation, because the current limiting device 25 is coupled between the power device 23 and the scan driver 21, the current limiting device 25 limits instantaneous current output from the power device 23. As a result, current received by the scan driver 21 decreases and power loaded by a Vgh bonding area, transmitting the scan signals, also decreases.

Figure 3:
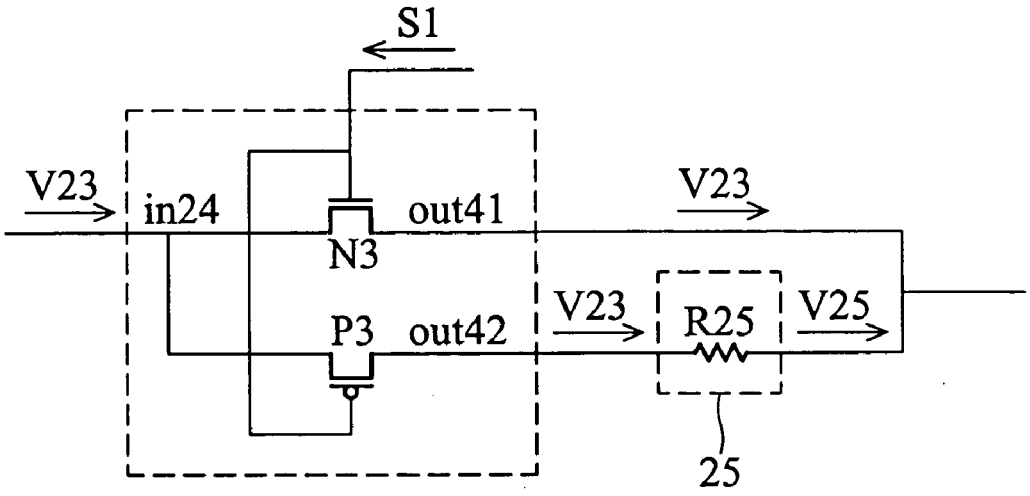
FIG. 3 shows one example circuit of the selection device and current limiting device of the present invention.

FIG. 3 shows one example circuit of the selection device 24 and current limiting device 25 of the present invention. The selection device 24 comprises two switches realized with an NMOS transistor N3 and a PMOS transistor P3 respectively. The current limiting device 25 is realized with a resistor R25. Input terminals of the NMOS transistor N3 and the PMOS transistor P3 are both coupled to the power device 23 and receive the voltage signal V23. Control terminals of the NMOS transistor N3 and the PMOS transistor P3 are both coupled to the scan driver 21. Output terminals of the NMOS transistor N3 and the PMOS transistor P3 are coupled to the output terminals out41 and out42 respectively.

In normal operation, the control terminals of the NMOS transistor N3 and the PMOS transistor P3 receive a signal, at a high voltage level, from the scan driver 21. The NMOS transistor N3 is turned on and the PMOS transistor P3 turned off. The input terminal in24 is coupled to the output terminal out41, such that the voltage signal V23 is directly applied to the scan driver 21. During shutdown process, the control terminals of the NMOS transistor N3 and the PMOS transistor P3 receive the erase signal S1, at a low voltage level. The NMOS transistor N3 is turned off and the PMOS transistor P3 turned on. The input terminal in24 is coupled to the output terminal out42, such that the voltage signal V23 is applied to the resistor R25. Moreover, the resistor R25 outputs the voltage signal V25 to the scan driver 21.

Figure 4:
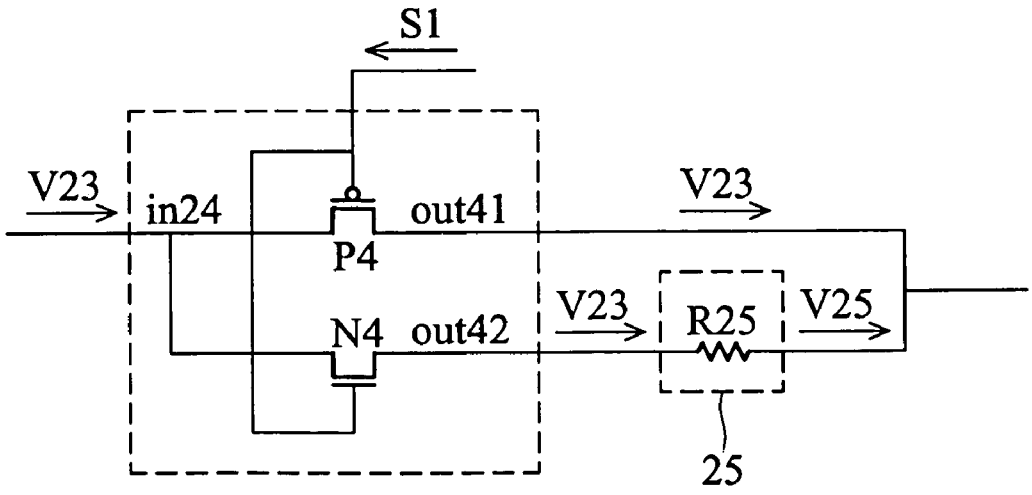
FIG. 4 shows an other example circuit of the selection device and current limiting device of the present invention.

FIG. 4 shows an other example circuit of the selection device 24 and current limiting device 25 of the present invention. The selection device 24 comprises two switches realized with an NMOS transistor N4 and a PMOS transistor P4 respectively. Similarly, the selection device 25 is realized with a resistor R25. Input terminals of the NMOS transistor N4 and the PMOS transistor P4 are both coupled to the power device 23 and receive the voltage signal V23. Control terminals of the NMOS transistor N4 and the PMOS transistor P4 are both coupled to the scan driver 21. However, output terminals of the NMOS transistor N4 and the PMOS transistor P4 are coupled to the output terminals out42 and out41 respectively.

In normal operation, the control terminals of the NMOS transistor N4 and the PMOS transistor P4 receive a signal, at the low voltage level, from the scan driver 21. The NMOS transistor N4 is turned off and the PMOS transistor P4 turned on. The input terminal in24 is coupled to the output terminal out41, such that the voltage signal V23 is directly applied to the scan driver 21. During shutdown process, the control terminals of the NMOS transistor N4 and the PMOS transistor P4 receive the erase signal S1, at the high voltage level. The NMOS transistor N4 is turned on and the PMOS transistor P4 turned off. The input terminal in24 is coupled to the output terminal out42, such that the voltage signal V23 is applied to the resistor R25. Moreover, the resistor R25 outputs the voltage signal V25 to the scan driver 21.

According to the present invention, the selection device 24 and the current limiting device 25 limit the instantaneous current output from the power device 23. In normal operation of the liquid crystal display, because the scan driver 21 sequentially outputs the scan signals, at a voltage level of the voltage signal V23, to scan electrodes $G2_1$ to $G2_x$, power is not centralized in a Vgh bonding area. The power device 23 directly applies the voltage V23 to the scan driver 21. However, during shutdown process of the liquid crystal display, because the scan driver 21 simultaneously outputs the scan signals, at the voltage level of the voltage signal V25, to all the scan electrodes $G2_1$ to $G2_x$, power is centralized in the Vgh bonding area. Therefore, according to the selection device 24, the voltage signal V23 from the power device 23 is applied to the scan driver 21 through the current limiting device 25. The current limiting device 25 limits instantaneous current output from the power device 23, avoiding burn-through in the Vgh bonding area.

Similarly, during power on process of the liquid crystal display, the scan driver outputs an erase signal S1 to the selection device 24 according to the Xon function. Thus, instantaneous current from the power device 23 is provided to the scan driver 21 through the current limiting device 23, reducing the amount of current received by the scan driver 21.

While the invention has been described by way of example and in terms of the preferred embodiments, it is to be understood that the invention is hot limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A liquid crystal display, comprising:

a power device;

a display unit array;

a scan driver, coupled to the power device, outputting a plurality of scan signals to the display unit array, wherein the scan driver sequentially outputs the scan signals to the display unit array in normal operation of the liquid crystal display, and the scan driver outputs an erase signal and all the scan signals during shutdown and power on processes of the liquid crystal display;

a selection device having a first input terminal coupled to the power device, a first output terminal coupled to the scan driver, a second output terminal, and a first control terminal, wherein when the first control terminal receives the erase signal, and the selection device couples the first input terminal to the second output terminal; and a current limiting device, coupled between the second output terminal and the scan driver, limiting instantaneous current from the power device when the scan driver simultaneously outputs all the scan signals.

2. The liquid crystal display as claimed in claim 1, wherein the selection device comprises:

a first switch, having a second input terminal coupled to the first input terminal, a second control terminal coupled to the first control terminal, and a third output terminal coupled to the first output terminal, turned on and coupling the first input terminal to the first output terminal in normal operation; and a second switch, having a third input terminal, a third control terminal coupled to the first terminal, and forth output terminal coupled to the second output terminal, turned on according to the erase signal and coupling the first input terminal to the second output terminal during shutdown and power on processes.

3. The liquid crystal display as claimed in claim 2, wherein the first and second switches are MOS transistors.

4. The liquid crystal display as claimed in claim 3, wherein the erase signal is at a low voltage level.

5. The liquid crystal display as claimed in claim 4, wherein the first switch is an NMOS transistor and the second switch is a PMOS transistor.

6. The liquid crystal display as claimed in claim 3, wherein the erase signal is at a high voltage level.

7. The liquid crystal display as claimed in claim 6, wherein the first switch is an PMOS transistor and the second switch is a PNMOS transistor.

8. The liquid crystal display as claimed in claim 1, wherein the current limiting device is a resistor.

* * * * *